US005200645A

United States Patent [19]

Laeuffer

[11] Patent Number: 5,200,645

[45] Date of Patent: Apr. 6, 1993

[54] DEVICE FOR OBTAINING AND SWITCHING HIGH VOLTAGES APPLIED TO X-RAY TUBE ELECTRODES

[75] Inventor: Jacques Laeuffer, Paris, France

[73] Assignee: General Electric CGR S.A., Les Moulineaux, France

[21] Appl. No.: 772,888

[22] Filed: Oct. 8, 1991

[30] Foreign Application Priority Data

Oct. 9, 1990 [FR] France ..... 90 12441

[51] Int. Cl.[5] ..... H05G 1/32

[52] U.S. Cl. ..... 307/82; 363/17; 363/71; 378/113; 378/137

[58] Field of Search ..... 363/17, 28, 71; 378/112, 113, 137; 307/82

[56] References Cited

U.S. PATENT DOCUMENTS

| | | | |
|---|---|---|---|
| 3,389,253 | 6/1968 | Kok . | |
| 4,013,936 | 3/1977 | Hesler et al. | 307/82 |
| 4,685,118 | 8/1987 | Furbee et al. | 378/114 |
| 4,908,752 | 3/1990 | Suzuki et al. | 363/17 |
| 5,001,618 | 3/1991 | Laeuffer | 363/28 |

FOREIGN PATENT DOCUMENTS

| | | |
|---|---|---|
| 052269 | 5/1982 | European Pat. Off. . |
| 115731 | 8/1984 | European Pat. Off. . |
| 336849 | 10/1989 | European Pat. Off. . |

*Primary Examiner*—William H. Beha, Jr.
*Attorney, Agent, or Firm*—Pollock, VandeSande & Priddy

[57] ABSTRACT

Disclosed is a device that can be used to obtain voltages for the biasing of the electrodes used to deflect the electron beam emitted by a cathode of an X-ray tube. Four DC voltages $\pm V_1$ and $\pm V_2$ are generated and applied to a mixing circuit in which they are added by using diodes to floating reference pulse voltages $\pm V_3$ so as to obtain voltages $VS_1$, $VS_2$, $VS'_1$, $VS'_2$ for the charging of capacitors such that:

$$VS_1 = V_3 - V_1 \text{ and } VS_2 = -V_3 + V_2$$

$$VS'_1 = -VS_3 + V_2 \text{ and } VS'_2 = V_3 - V_1$$

8 Claims, 5 Drawing Sheets

DEVICE FOR OBTAINING AND SWITCHING HIGH VOLTAGES APPLIED TO X-RAY TUBE ELECTRODES

BACKGROUND OF THE INVENTION

1. Field of the Invention

The invention generally relates to radiology instruments and, more particularly, it relates to devices for biasing electrodes of X-ray tubes, with high voltages and for switching the same speedily.

An X-ray tube comprises, in a vacuum chamber, a cathode constituted by a heated filament that emits electrons and a focusing device baked on to the filament that focuses the emitted electrons on an anode at a positive potential with respect to the cathode. The point of impact of the electron beam on the anode constitutes the X-radiation source.

To shift the X-ray beam angularly, it is generally proposed to shift the point of impact of the electron beam on the anode by using a deflecting device. This deflecting device is usually constituted by magnetic or electrostatic lenses which are placed on the path of the beam or in the vicinity of this path between the cathode and the anode. The use of these lenses necessitates a non-negligible level of energy owing to the substantial kinetic energy of the electrons of the beam. This substantial kinetic energy is due to their high speed as a result of high potentials difference of more than 100 kilovolts, between the cathode and the anode.

2. Description of the Prior Art

In French patent No. 2 538 948, there is disclosed an X-ray tube with scanning, in which the focusing device has at least two metal parts that are electrically insulated from one another and from the filament so as to enable them to be biased or polarized independently with respect to the filament, and so as to thus obtain a deflection of the electron beam.

FIG. 1 gives a schematic view of an X-ray tube of the type described in the above-mentioned patent. It comprises, in a vacuum chamber represented by the dashed rectangle 11, a filament 12, a focusing device 13 backed on to the filament 12 and an anode 14. The filament 12 and the focusing device 13 constitute a cathode C. The focusing device 13 is constituted by a first metal part 15 and a second metal part 16 that are electrically insulated from each other by an insulating partition wall 17 fixedly joined to an insulating base 18. The metal parts 15 and 16 are placed symmetrically on either side of the filament 12 with respect to a plane of symmetry perpendicular to the plane of FIG. 1. This plane of symmetry contains the axis of the filament 12 perpendicular to the plane of FIG. 1. This plane of symmetry contains the axis of the filament 12 perpendicular to the plane of FIG. 1 and is perpendicular to the base 18. The intersection of this plane of symmetry with the plane of FIG. 1 defines the axis 19 of the electron beam.

The voltages that are applied to the metal parts 15 and 16 are chosen so as to focus the electrons on a determined surface of the anode 14. In modifying these voltages, it is possible to shift the point of impact of the electron beam on the anode, but the characteristics of the impact surface are also modified.

Thus, to obtain relatively major deflections of the electron beam without modifying the characteristics of the impact surface, a known method uses two additional metal electrodes $W_1$ and $W_2$ which are borne by the focusing piece 13 at the end of the last stepped portion of each metal part 15 and 16.

These electrodes $W_1$ and $W_2$ are respectively insulated from the metal parts 15 and 16 by an insulating portion 20 or 21, made of alumina for example.

When no voltage $VS_1$ or $VS_2$ is applied between the filament 12 and, respectively, the electrode $W_1$ and the electrode $W_2$, an electron beam F is emitted along the axis 19.

When equal voltages are applied to the electrodes $W_1$ and $W_2$, the cathode C emits an electron beam F along the axis 19, the concentration of which is obtained by the geometry of the cathode C.

To obtain a deflection of the electron beam, namely to give this beam a mean direction that is different from the axis 19, it is sufficient to introduce a dissymmetry into the electric field created around the electron beam by giving different values to the voltages $VS_1$ and $VS_2$ applied to the metal electrodes $W_1$ and $W_2$. Thus, a beam F' with an axis 19' is obtained for a positive voltage $VS_1$ and a negative voltage $VS_2$. On the contrary, a beam F'' with an axis 19'' is obtained for a negative voltage $VS_1$ and a positive voltage $VS_2$.

To obtain a deflection of the beam of the order of one millimeter to several millimeters in the case of a filament-anode distance of twenty millimeters, it is necessary to apply voltages $VS_1$ and $VS_2$ of the order of 2,000 to 3,000 volts.

More precisely, as can be seen in the graphs of FIGS. 2-a and 2-b, equal and opposite voltages of $+V_1$ are applied to the electrodes $W_1$ and $W_2$ to obtain a (1 certain position of the focal spot, and equal and opposite voltages of $+V_2$ are applied to obtain another position of the focal spot. It is therefore necessary to switch voltages over from $+V_1$ to $-V_2$ and then again to $+V_1$ on the electrode $W_1$ and from $-V_1$ to $+V_2$ and then again to $-V_1$ on the electrode $W_2$.

FIG. 3 shows a block diagram of a device for switching the voltages $\pm V_1$ and $\pm V_2$. It comprises four voltage generators $G_1$, $G_2$, $G_3$ and $G_4$ which respectively provide the voltages $+V_1$, $-V_1$, $-V_2$ and $+V_2$, these voltages being applied to the electrodes $W_1$ and $W_2$ by means of switches $I_1$, $I_2$, $I_3$ and $I_4$, the opening and closing of these switches being activated respectively by signals $P_1$, $P_2$, $P_3$ and $P_4$ given by a control circuit P. By simultaneously closing the switches $I_1$ and $I_2$, with $I_3$ and $I_4$ being open, a voltage $+V_1$ is applied to $W_1$ and a voltage $-V_1$ is applied to $W_2$. Similarly, by simultaneously closing $I_3$ and $I_4$, with $I_1$ and $I_2$ being open, a voltage $-V_2$ is applied to $W_1$ and a voltage $+V_2$ is applied to $W_2$.

There are many known electronic circuits that can be used to perform the functions described in relation to the block diagram of FIG. 3. For this switching operation, increasing use is being made of metal-oxide type field-effect transistors or MOSFETs. However, these transistors generally cannot withstand voltages of more than some hundreds of volts which means that several of them (for example seven of them) have to be placed in series to enable the switching of a voltage of several thousands of volts. Furthermore, it is necessary to have a power control circuit for all the transistors of the switch for the application of the signals $P_1$ to $P_4$, which leads to design appropriate power circuit.

Besides, it happens that the X-ray tube gets short-circuited between the cathode and the anode, and the result thereof is that the transistors of the switch are subjected to electromagnetic disturbances against which they should be shielded, for example by using clamping circuits. A switching device such as this therefore leads to the use of many costly and bulky components.

An object of the present invention, therefore, is to design a device for switching high bias voltages, that is simple, inexpensive and does not use switching transistors.

At last, switching transistors as well as their control and protection circuits are borne to a potential of −75 kilovolts in relation to the ground, which makes it necessary to place them in an insulating high voltage unit, namely in an insulating chamber containing an insulating fluid, said high voltage unit also providing the high voltages applied to the cathode and the anode.

Hence, another object of the present invention is to design a device for switching high biasing voltages that switches said voltages with respect to the ground and not with respect to the cathode potential of −75 kilovolts, thus enabling it to be placed outside the high voltage unit which produces the supply voltages of the cathode and of the anode.

SUMMARY OF THE INVENTION

The invention relates to a device used to obtain and to switch X-ray tube electrode biasing voltages $VS_1$, $VS_2$ or $VS'_1$, $VS'_2$, said device comprising:

first means for generating a first pair of adjustable DC voltages $+V_1$, $-V_1$ with equal and opposite amplitudes, second means for generating a second pair of adjustable DC voltages $+V_2$, $-V_2$ with equal and opposite amplitudes, third means for generating a pair of pulse voltages $+V_3$, $-V_3$ with equal and opposite amplitudes, and fourth means connected to the first, second and third means, for combining the pair of pulse voltages $+V_3$, $-V_3$, at determined instants, with one of the voltages of the first and second pairs of DC voltages so as to charge capacitors and obtain DC voltages $$VS_1 = V_3 - V_1 \text{ and } VS_2 = -V_3 + V_2$$

during a certain period of time, and then DC voltages $$VS'_1 = -V_3 + V_2 \text{ and } VS'_2 = +V_3 - V_1$$

during another period of time.

BRIEF DESCRIPTION OF THE DRAWINGS

Other objects, features and advantages of the invention will appear from the following description of an embodiment, said description being made with reference to the appended drawings, of which.

DETAILED DESCRIPTION OF THE INVENTION

Figure 1:
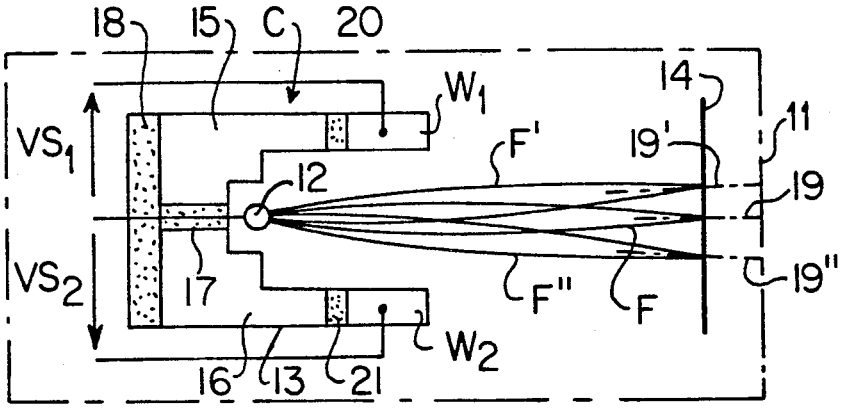
FIG. 1 is a schematic sectional view of a cathode and a anode of an X-ray tube that has electrodes for deflecting the electron beam.
Figure 2A:
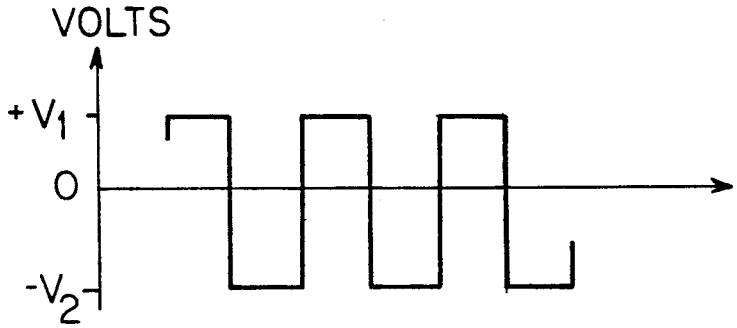
FIGS. 2-a and 2-b are timing diagrams of the voltages that are applied to the deflection electrodes.
Figure 2B:
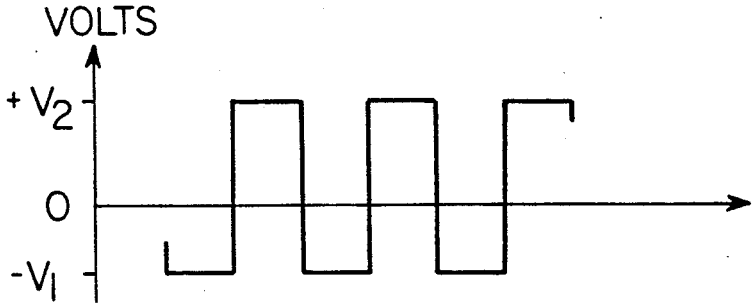
Figure 3:
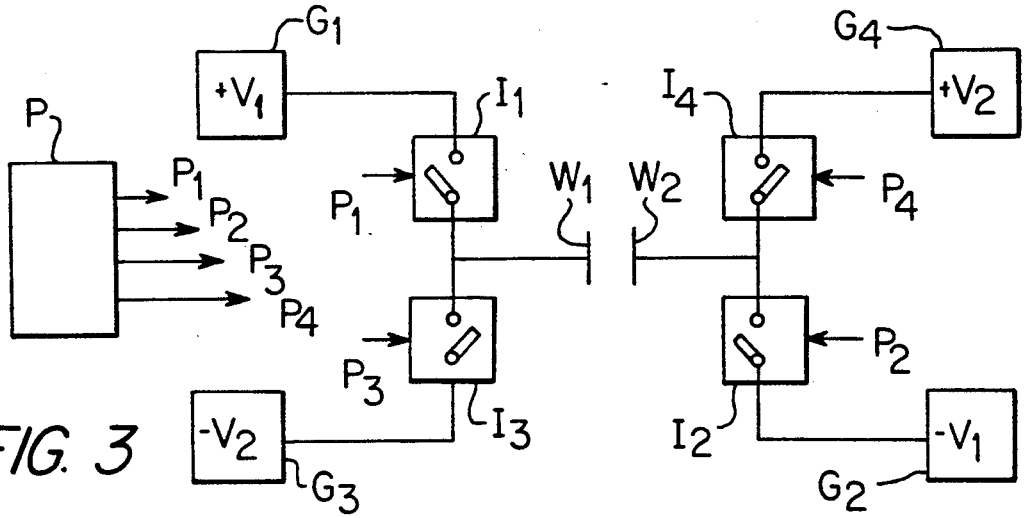
FIG. 3 is a diagram illustrating the principle of a bias voltage switching device.

The device, according to the invention, for obtaining and switching voltages comprises (FIG. 4) a first circuit 30 for obtaining the voltages $+V_1$ and $-V_1$, a second circuit 40 for obtaining the voltages $+V_2$ and $-V_2$ and a device 29, for switching said voltages $\pm V_1$ and $\pm V_2$ to which these latter voltages are applied.

The first and second circuits 30 and 40 are identical, and each of them has the following circuits which have been described in the French patent application No. 90 10348 filed on 14 August 1990 and entitled "Device for obtaining an adjustable DC voltage".

Firstly there is a microprocessor 31 (or 41) to which the user indicates, at its input terminal 50 (or 51), for example by means of a keyboard, the voltage $\pm V_1$ (or $+V_2$) to be obtained. The microprocessor 31 (or 41) gives a digital code $N_1$ (or $N_2$) which means a frequency $F_1$ (or $F_2$). This digital code $N_1$ (or $N_2$) is applied to a programmable counter 32 (or 42) which gives pulses of variable frequency $F_1$ (or $F_2$) according to the value of $N_1$ (or $N_2$). These pulses are applied to a control circuit 33 (or 43) which produces pulses for controlling a hyporesonant type converter circuit 34 (or 44). The output signals of the converter circuit 34 (or 35) are applied to a primary winding 35*p* (or 45*p*) of a pulse type transformer 35 (or 45), the secondary winding 35*s* or (45*s*) of which is connected to a rectifying and filtering circuit 36 (or 46) having three output terminals 37, 38 and 39 (or 47, 48 and 49). The output terminal 37 (or 47) is at the potential $+V_1$ (or $+V_2$) with respect to the terminal 39 (or 49). The output terminal 38 (or 48) is at the potential $-V_1$ (or $-V_2$) with respect to the terminal 39 (or 49); the output terminal 39 (or 49) is connected to a terminal 58 of the filament 12 (FIG. 1) and is therefore at the potential of this filament.

These different output terminals 37, 38 and 39 (or 47, 48 and 49) are connected to the switching device 29. The switching circuit 29 comprises a device 52 for obtaining a DC voltage E that is regulated and adjustable, a circuit 53 for switching the voltage E, a pulse type transformer 54 and a mixer circuit 55 for mixing the voltages $+V_1$, $+V_2$ with the voltages given by the transformer 54 so as to obtain the voltages applied to the electrodes $W_1$ and $W_2$ at output terminals 56, 57 and 58. These output terminals 56, 57 and 58 are respectively connected to the electrode $W_1$, the electrode $W_2$ and the emissive filament of the cathode (FIG. 1).

A detailed description shall now be given of the different circuits that have been presented here above in a functional way.

The microprocessor 31 (or 41) performs the function:

$$N_1 = f|V_1| \text{ (or } N_2 = f|V_2|)$$

i.e., for each value of the voltage $|V_1|$ (or $|V_2|$), it gives a digital code, for example a code with eight digits. This code, when applied to the counter 32 (or 42), causes said counter to provide frequency $F_1$ (or $F_2$) pulses. These frequency $F_1$ (or $F_2$) pulses are designed to control the switches of the converter circuit 34 (or 44) alternately by means of the circuit 33 (or 43), so as to create current pulses. The rectifying and filtering of these current pulses in the circuit 36 (or 46) lead to the desired voltages $+V_1$ (or $+V_2$) between the terminals 39, 37 and 39, 38 (or 49, 47 or 49, 48).

Figure 7:
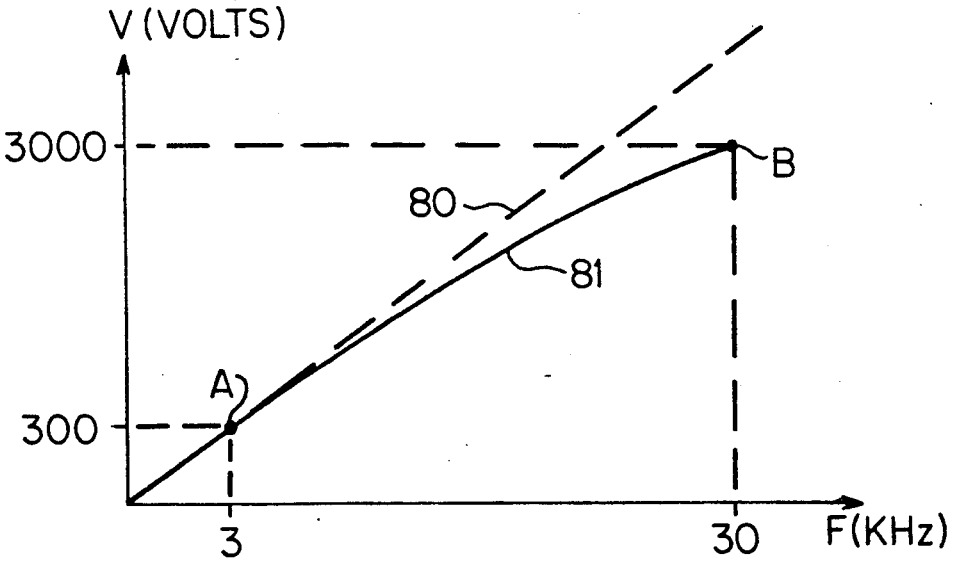
FIG. 7 is a graph showing the curve of calibration of the circuit 30 or of the circuit 40 of the device of FIG. 4.
Figure 8A:
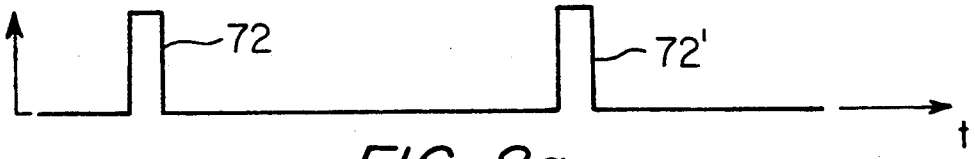
FIGS. 8-a to 8-f are graphs enabling an understanding of the operation of the circuits 30 and 40 of the device of FIG. 4.
Figure 8B:
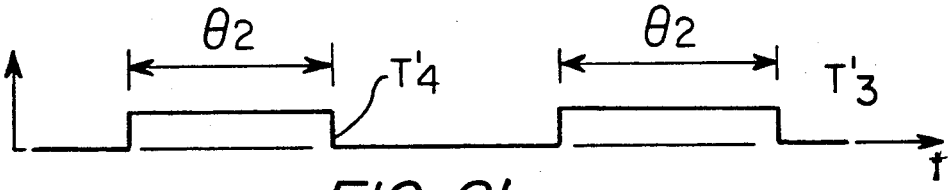
Figure 8C:
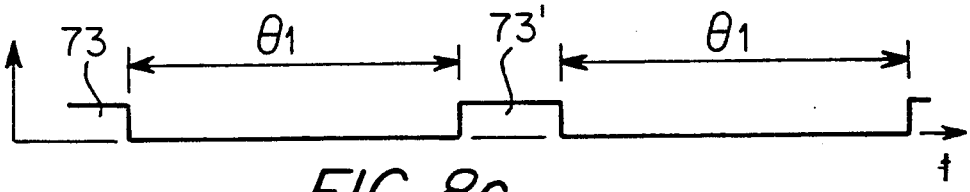
Figure 8D:
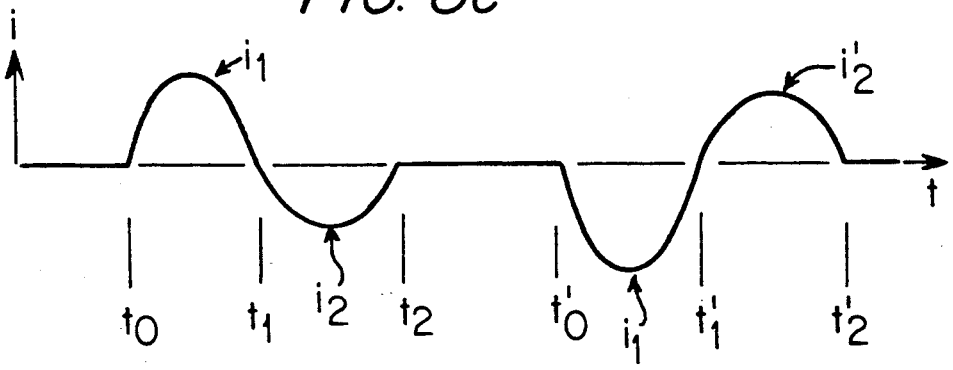
Figure 8E:
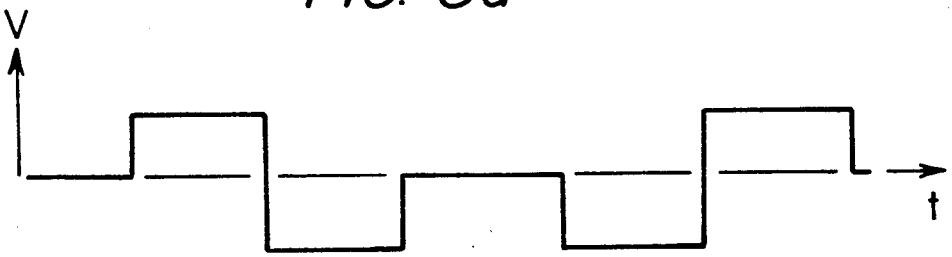
Figure 8F:
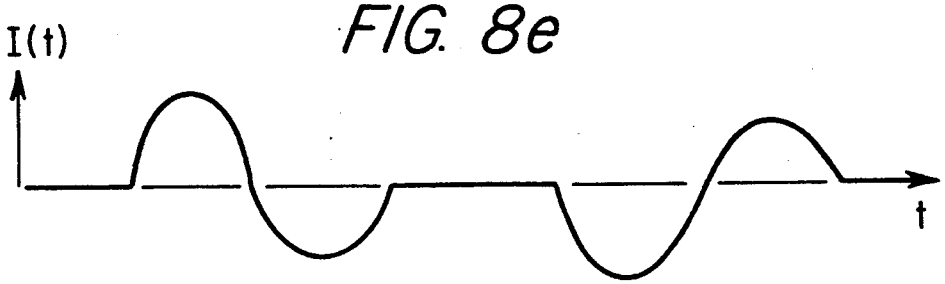

In other words, the microprocessor 31 and the counter 32 perform the function $F_1=f'|V_1|$ (or $F_2=f'|V_2|$). This function is obtained by calibration and its shape is given by the curve 81 of FIG. 7. This curve 81 takes account of the linearity defects of the system while the curve 80 is a theoretical curve.

Figure 6:
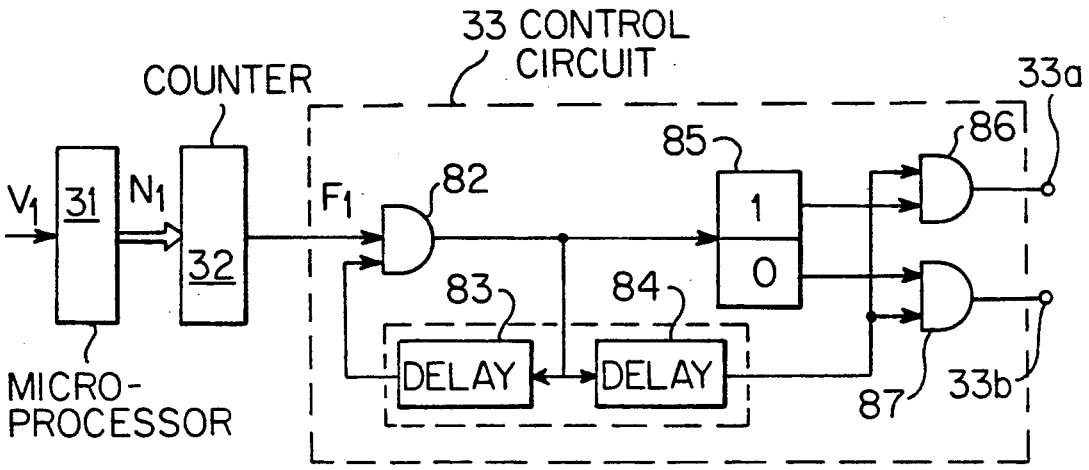
FIG. 6 is a diagram of a control circuit 33 (or 43) of the converter circuit 34 (or 44)

The control circuit 33 (or 43) has (FIG. 6) a first logic AND circuit 82 that comprises two input terminals, to one of which are applied the pulses of variable frequency $F_1$ (or $F_2$) given by the circuit 32 (or 42) while the other input terminal is connected to a [first delay circuit 83, the delay of which is $\theta_1$. The output terminal of the AND circuit 82 is connected, firstly, to a bistable circuit 85 and, secondly, to the first delay circuit 83 as well as to a second delay circuit 84, the delay of which is $\theta_2$.

The output terminal corresponding to the state 1 of the bistable circuit 85 is connected to one of the two input terminals of a second logic AND circuit 86 while the output terminal corresponding to the state 0 is connected to one of the two input terminals of a third logic AND circuit 87. The second input terminal of the AND circuits 86 and 87 is connected to the output terminal of the second delay circuit 84. The output terminals of the AND circuits 86 and 87 respectively bear the references 33*a* and 33*b*.

The converter circuit 34 (or 44) has at least two switches $T_3$, $T_4$ (or $T_5$, $T_6$), made with field-effect transistors according to metal-oxide semiconductor technology (i.e. these transistors are MOSFETs). By construction, each of these transistors $T_3$, $T_4$ (or $T_5$, $T_6$) has, in parallel, a diode $D_{14}$ (or $D_{16}$) for the transistor $T_4$ (or $T_6$) and a diode $D_{13}$ (or $D_{15}$) for the transistor $T_3$ (or $T_5$). The anode of each of these diodes is connected to the source of the associated transistor and the cathode of each of said diodes is connected to the drain of the associated transistor. The gate of the transistor $T_4$ (or $T_6$) is connected to the output 33*a* (or 43*a*) of the control circuit 33 while the gate of the transistor $T_3$ or $T_5$ is connected to the output 33*b* (or 43*b*) of the control circuit 33 (or 43).

The converter circuit also includes a resonant circuit comprising capacitors $C_5$ and $C_6$ (or $C_7$ and $C_8$) and a coil $L_1$ (or $L_2$) The capacitors $C_5$ and $C_6$ are series-connected between the drain of the transistor $T_4$ and the source of the transistor $T_3$, while the coil $L_1$ (or $L_2$) is connected in the primary circuit 35*p* (or 45*p*) of the transformer 35 (or 45). This coil $L_1$ (or $L_2$) is connected, on one side, directly to the source of the transistor $T_4$ (or $T_6$) and, on the other side, to the common point of the capacitors $C_5$ and $C_6$ (or $C_7$, $C_8$), by means of the primary winding 35*p* (or 45*p*) of the transformer 35 (or 45). In a known variation, the converter circuit may have only one capacitor instead of two capacitors $C_5$ and $C_6$ (or $C_7$, $C_8$). This single capacitor would be connected, for example, to the negative terminal of the supply circuit 52.

The rectifying and filtering circuit 36 (or 46) is of a standard type, and comprises rectifier diodes $D_5$ and $D_6$ (or $D_7$, $D_8$) and filtering capacitors $C_1$ and $C_2$ (or $C_3$, $C_4$) which are connected to each other in a known way. The output impedance of the circuit 36 (or 46) is constituted by two resistors of equal values $R_1$ and $R_2$ (or $R_3$ and $R_4$), the common point of which constitutes the output terminal 39 (or 49) which is connected to the common point of the capacitors $C_1$ and $C_2$ (or $C_3$ and $C_4$). The voltage $+V_1$ (or $+V_2$) is then obtained between the terminals 39 and 37 (or 49 and 47) and the voltage $-V_1$ (or $-V_2$) is obtained between the, terminals 39 and 38 (or 49 and 48).

The operation of the circuit 30 alone shall now be explained with the help of FIGS. 4, 6, 7 and 8, the operation of the circuit 40 being identical. To a bias voltage $+V_1$, there corresponds a digital code $N_1$. This digital code $N_1$, when applied to the counter 32, leads this counter to provide pulses 72 and 72' (FIG. 8-a) at the frequency $F_1$ according to the correspondence given by the curve 81 of FIG. 7. These pulses have, for example, a frequency of 30 kilohertz to obtain $|V_1|=3{,}000$ volts and a duration of about one microsecond. If it is assumed that the delay circuit 83 gives an opening signal 73, the pulse 72 activates the changing of the state of the bistable circuit 85 which switches, for example, to the state 1. The pulse 72 activates the delay circuit 83 to end the opening signal 73 (FIG. 8-c) so that the AND circuit 82 closes during a period of time $\theta_1$. The pulse 72 also activates the delay circuit 84 to make it provide a signal $T'_4$ with a duration $\theta_2$ (FIG. 8-b) that turns the AND circuits 86 and 87 on. Only the AND circuit 86, which receives the state 1 signal from the bistable circuit 85, gives a signal $T'_4$ that makes the transistor $T_4$ conductive at the instant $t_o$ (FIG. 8-d).

This signal $T'_4$ makes the transistor $T_4$ conductive and keeps it in this state, and a current $i_1$ (FIG. 8-d), called a positive current, flows in the transistor $T_4$, the coil $L_1$, the primary winding 35*p* of the transformer 35, the capacitors $C_5$ and $C_6$ (in fact $i_1/2$ in each capacitor) and the supply circuit 52.

This current $i_1$ leads to a square-wave voltage V (FIG. 8-e) at the terminals of the primary winding 35*p*, and the result thereof is a current I(t) (FIG. 8-f) in the secondary winding 35*s* of the transformer 35. This current has a shape identical to that of the current $i_1$ flowing in the primary winding.

The current $i_1$ charges the capacitor $C_5$ and discharges the capacitor $C_6$ and their charging voltage counters the flow of the current $i_1$ so that this current $i_1$ gets cancelled out at the instant $t_1$, i.e. before the end of the signal $T'_4$. The capacitor $C_5$ then gets discharged while the capacitor $C_6$ gets charged and a current $i_2$ (FIG. 8-d), called a negative current, flows in the capacitors $C_5$ and $C_6$ (in fact $i_2/2$ in each capacitor), the primary winding 35*p*, the coil $L_1$, the diode $D_{14}$ and the supply circuit 52.

This negative current leads to a square-wave negative voltage (FIG. 8-e) at the terminals of the primary winding 35*p* and, consequently, to a negative current I(t) (FIG. 8-f) in the secondary winding 35*s*. When the current $i_2$ gets cancelled out, the pulse is ended.

Before the instant $t_2$, the signal $T'_4$ comes to an end by the effect of the delay circuit 84 introducing a delay $\theta_2$ so that the AND circuits 86 and 87 are off.

After the instant $t_2$, and more precisely after a delay $\theta_1$ measured from the end of the signal 73 (FIG. 8-c), the delay circuit 83 gives a signal 73' that turns the AND circuit 82 on.

After a variable period of time defined by the frequency $F_1$, a pulse 72' is provided by the counter 32, and its leading edge activates the change in the state of the bistable circuit 85, which switches to the state 0, as well as the zero-setting of the delay circuits 83 and 84.

This zero-setting operation has the effect of ending the signal 73' and of giving the signal T'3 which opens the AND circuits 86 and 87. Since the bistable circuit 85 is in the state 0, only the AND circuit 87 gives an output signal at the terminal **33*b* and a pulse is applied to the control electrode of the transistor $T_3$ at the instant $t'_o$ to make it conductive. A current $i'_1$, called a negative current, then flows in the transistor $T_3$, the circuit 52, the capacitors $C_5$ and $C_6$ (in fact $i'_1/2$ in each capacitor), the primary winding 35*p* of the transformer 35 and the coil $L_1$. This negative current leads to a square-wave negative voltage V (FIG. 8-e) at the terminals of the primary winding 35*p*, and the result thereof is a negative current I(t) (FIG. 8-f) in the secondary winding 35*s* of the transformer 35**. This current has a shape identical to that of the current $i'_1$ flowing in the primary winding.

The negative current $i'_1$ charges the capacitor $C_6$ and discharges the capacitor $C_6$ and their charging voltage counters the flow of the current $i'_1$ so that this current $i'_1$ gets cancelled out at the instant $t'_1$. The capacitor $C_6$ then gets discharged while the capacitor $C_6$ gets charged and a positive current $i'_2$ flows in the capacitors $C_5$ and $C_6$ (in fact $i'_2/2$ in each capacitor), the primary winding **35*p*, the coil $L_1$, the diode $D_{13}$ and the supply circuit 52. This positive current leads to a square-wave positive voltage (FIG. 8-e) at the terminals of the primary winding 35*p* and, consequently, to a positive current I(t) (FIG. 8-f) in the secondary winding 35*s***. When the current $i'_2$ gets cancelled out, the pulse is ended.

The pulses thus created by the converter circuit 34 are applied to the transformer 35 and are rectified and filtered in the circuit 36 so that, at the terminals of the each resistor $R_1$ and $R_2$, there appears a voltage $V_1$ corresponding to the frequency $F_1$ determined by calibration.

This relationship between the frequency $F_1$ and the voltage $V_1$ results from the fact that the electrical charge contained in each pulse (FIGS. 8-d and 8-f) is always the same whatever may be the point of operation, provided that the frequency $F_1$ is lower than the frequency of the resonant circuit of the converter circuit. This means that the ripple circuit is of the pulse hyporesonant type.

As a matter of fact, the electrical charge Q of a pulse (FIG. 8-d) is given by:

$$Q = \int_{t_o}^{t_2} |I|dt = \frac{T}{2} \times \frac{2}{\pi} \times \frac{E/2 + V}{Z} + \frac{T}{2} \times \frac{2}{\pi} \frac{E/2 - V}{Z}$$

with

E: the supply voltage

V: the voltage at the terminals of the primary winding **35*p***

$Z = \sqrt{L/C}$ : the impedance of the resonant circuit with $C = C_5 + C_6$

-continued $$T = 2\pi\sqrt{LC}$$

From the above, it can be deduced Q=2 CE, i.e. a constant if E and C are constant, which is the case as the supply circuit 52 gives a regulated voltage and the capacitance C is fixed in manufacture.

Now the current $I_4$ that flows in the load resistor $R_1$ is given by:

$$I_r = Q \times F_1$$

so that the voltage $V_1 = R_1 = R_1 \times Q \times F_1$, which means that $V_1$ is proportional to $F_1$ if $R_1$ and Q are constants. This corresponds to the dashed curve 80 of FIG. 7. However, in practice, the phenomenon is not perfectly linear and the real curve is the one referenced 81. If the device according to the invention is to work according to the curve 81, it is necessary to carry out a calibration in using at least two points of operation, for example those defined by A and B on the curve 81.

In the switching circuit 29, the circuit 52 for obtaining the DC voltage E comprises a first rectifying and filtering circuit 59 which is supplied by the AC mains system between the terminals 63 and 64. The DC voltage provided by the circuit 59 is applied to a hyporesonant type converter circuit 60, similar to the above-described converter circuits 34 and 44. This converter circuit 60 comprises two MOSFET transistors $T_7$ and $T_8$ series connected between the output terminals of the circuit 59 and a resonant circuit comprising capacitors $C_{11}$ and $C_{12}$, coil $L_3$ and the primary winding of a pulse type transformer 61. A terminal of the coil $L_3$ connected directly to the common point of the transistors $T_7$ and $T_8$, while the other terminal is connected to the common point of the capacitors $C_{11}$ and $C_{12}$ through the primary winding of the transformer 61.

The secondary winding of the transformer 61 is connected to a rectifying and filtering circuit 62 which comprises diodes $D_9$, $D_{10}$, $D_{11}$ and $D_{12}$ mounted as a rectifier bridge, a filtering electrolytic capacitor $C_{13}$ and a resistive divider bridge comprising the resistors $R_7$ and $R_8$.

This circuit 62 provides a DC voltage E which is regulated and adjustable by means of a circuit 65. This circuit 65 receives a voltage that mirrors the voltage E provided by the resistive bridge and a voltage $E_C$ chosen by the user. This circuit 65 thus gives pulses to control the transistors $T_7$ and $T_8$ in such a way that the difference $(E-E_c)$ is null, which means that $E=E_C$. This circuit 65 may be of the voltage/frequency converter type.

This DC voltage E is applied to the converter circuits 34 and 44 described here above, and to the switching circuit 53. The switching circuit has a first MOSFET transistor $T_1$ which is supplied with the voltage E by means of a load resistor $R_5$ in series with the drain. This drain of the transistor $T_1$ is connected to a terminal of a first primary winding $54_1$ of the transformer 54 by means of a capacitor $C_{10}$, the other terminal of this first winding being directly connected to the positive terminal of the voltage E.

The switching circuit 53 comprises a second MOSFET transistor $T_2$ which is supplied with the voltage E by means of a load resistor $R_6$ in series with the drain. This drain of the transistor $T_2$ is connected to a terminal of a second primary winding $54'_1$ of the transformer 54 by means of a capacitor $C_9$, the other terminal of this second winding being directly connected to the positive terminal of the voltage E.

Figure 5A:
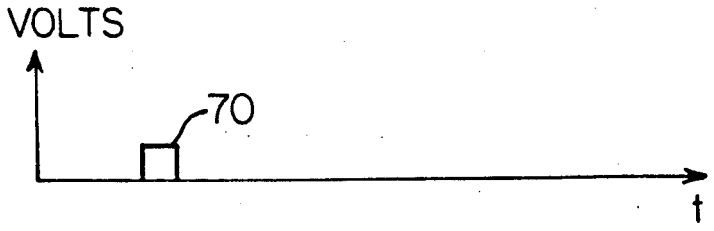
FIGS. 5-a to 5-d are timing diagrams of signals, to provide for an understanding of the way in which the voltages are obtained.
Figure 5B:
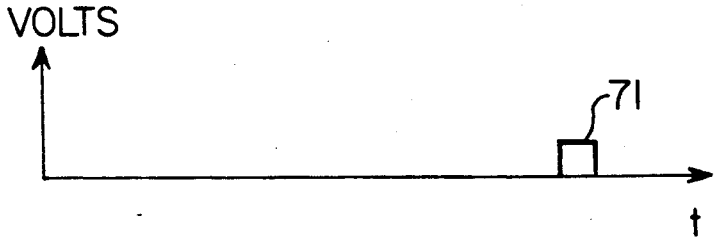
Figure 5C:
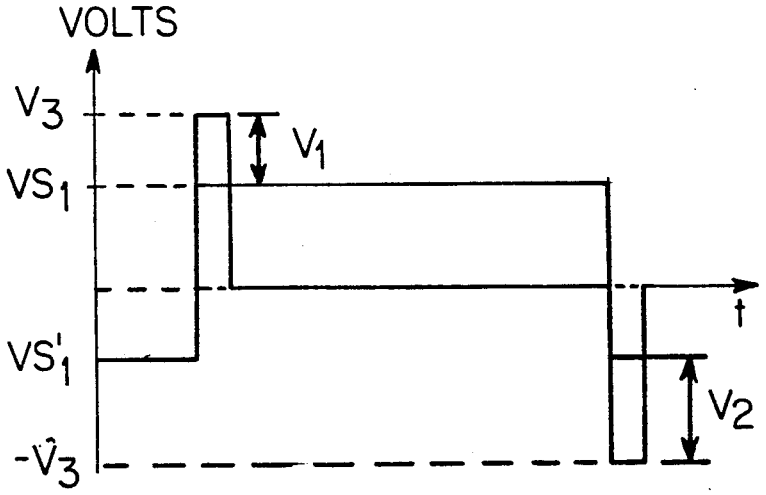
Figure 5D:
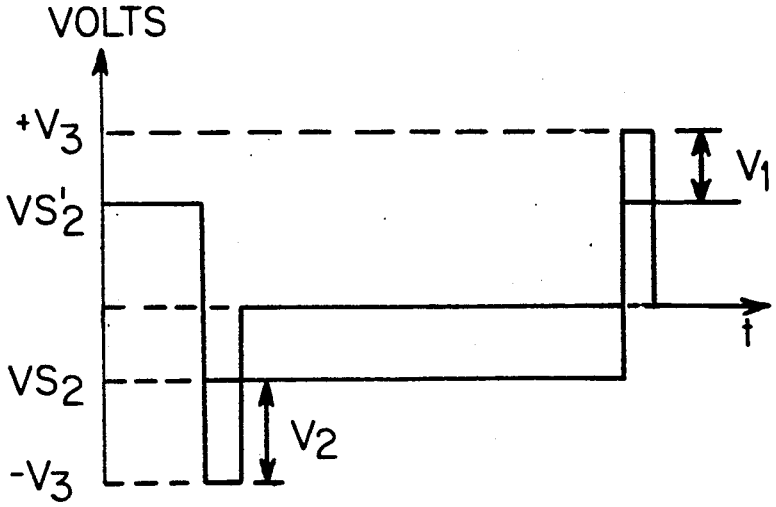

The control electrodes of the transistors $T_1$ and $T_2$ are connected to a control circuit 66 which gives pulses 70 and 71, respectively represented by the timing diagrams of FIGS. 5*a* and 5*b*. This control circuit 66 is itself controlled by a microprocessor 67 which defines the time intervals between the first pulse 70 and the first pulse 71, then between this first pulse 71 and the second pulse 70, and then between this second pulse 70 and the second pulse 71.

By way of an example, the pulses 70 and 71 have a fixed duration of some tens of microseconds while the time interval between them is of the order of one millisecond to a few milliseconds.

The two primary windings $54_1$ to $54'_1$ are wound in reverse directions, and this is also the case for the corresponding secondary windings $54_2$ and $54'_2$. The result of these directions of the windings is that the voltages $V_3$ and $V'_3$ appearing respectively at the output terminals of the secondary windings $54_2$ and $54'_2$ have opposite directions and are equal in terms of absolute value if the primary and secondary windings are identical.

The circuit 55 for mixing the voltages $+V_1$, $+V_2$ and $V_3$, $V'_3$ includes diodes $D_1$, $D_2$, $D_3$ and $D_4$. The diode $D_1$ has its anode connected to the output terminal 38 (voltage $-V_1$) of the rectifying and filtering circuit 36 and its cathode connected, firstly, to the anode of the diode $D_2$ and, secondly, to an output terminal of the secondary winding $54_2$, the other output terminal of said secondary winding $54_2$ constituting the output terminal 56 of the circuit 55 invention. The cathode of the diode $D_2$ is connected to the output terminal 47 (voltage $+V_2$) of the rectifying and filtering circuit 46. The diode $D_3$ has its anode connected to the output terminal 48 (voltage $-V_2$) of the rectifying and filtering circuit 46 and its cathode connected, firstly, to the anode of the diode $D_4$ and, secondly, to an output terminal of the secondary winding $54'_2$, the other output terminal of said winding constituting the output terminal 57 of the circuit 55. The cathode of the diode $D_4$ is connected to the output terminal 37 (voltage $+V_1$) of the rectifying and filtering circuit 36. Furthermore, the third output terminal 58 of the mixer circuit 55 is connected, firstly, to the common point of the resistors $R_1$ and $R_2$ of the rectifying and filtering circuit 36 and, secondly, to the common point of the resistors $R_3$ and $R_4$ of the rectifying and filtering circuit 46.

The voltage $VS_1$, which is applied between the filament and the electrode $W_1$, is taken between the output terminals 58 and 56 while the voltage $VS_2$, which is applied between the filament and the electrode $W_2$, is taken between the output terminals 58 and 57. The capacitors $C_{14}$ and $C_{15}$ represent the parasitic capacitances of the conductors which respectively connect the output terminals 56, 57 and 58 to the electrode $W_1$, the electrode $W_2$ and the filament 12.

Figure 4:
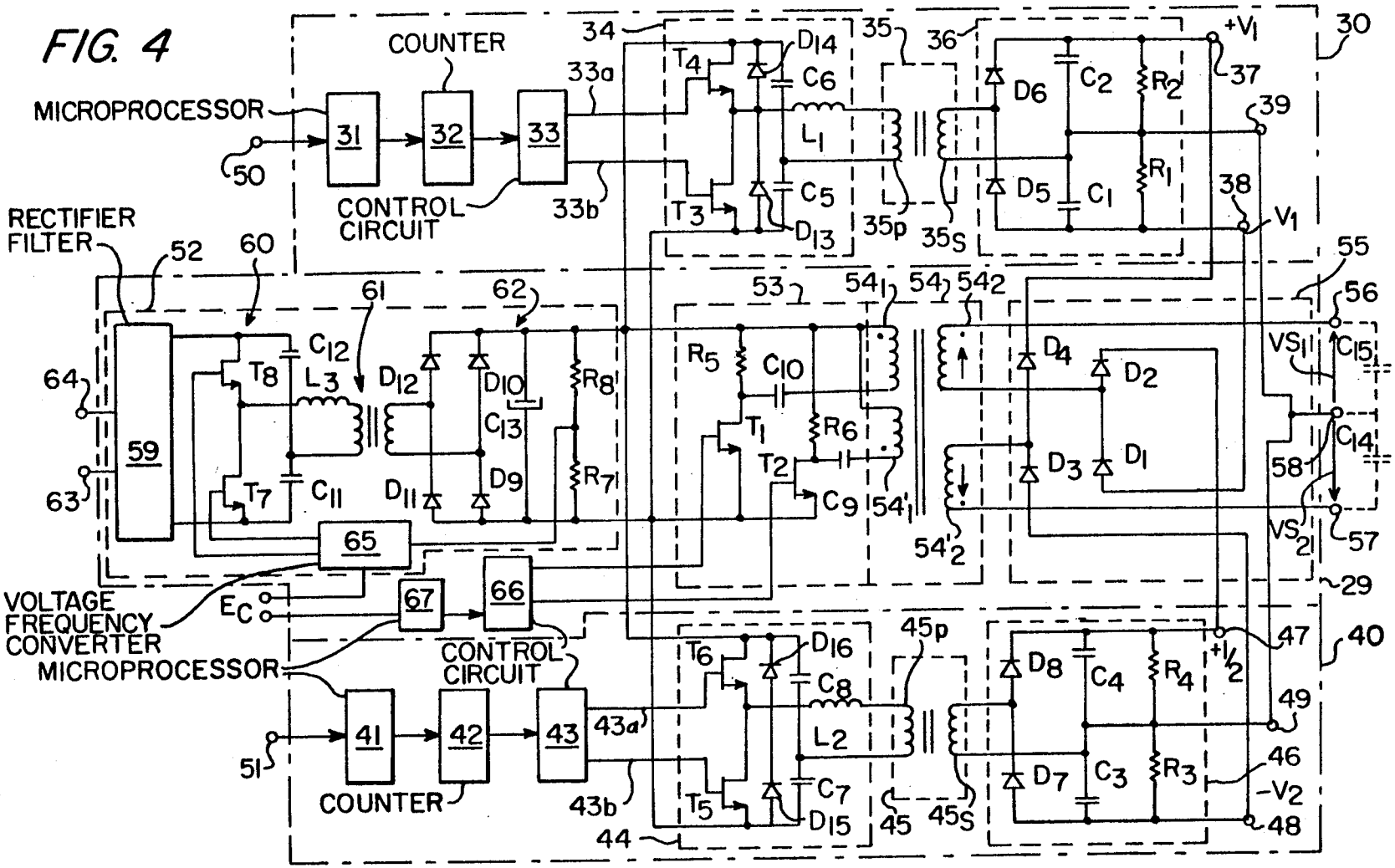
FIG. 4 is a diagram of the device used for obtaining and switching over bias voltages according to the invention.

The operation of the device of FIG. 4 shall now be explained with reference to the graphs of FIGS. 5*a*, 5*b*, 5*c* and 5*d*. FIGS. 5*a* and 5*b* represent the timing diagrams of two consecutive pulses 70 and 71 which define the instants at which the voltages applied to the electrodes $W_1$ and $W_2$ are switched. Naturally, in each diagram, these pulses are repetitive and have a duration of about twenty microseconds. The pulse 70 and the following ones (not shown) are applied to the control electrode of the transistor $T_1$ while the pulse 71 and the following ones (not shown) are applied to the control electrode of the transistor $T_2$.

The pulse 70 saturates the transistor $T_1$ in such a way that a positive voltage $+V_3$ appears at the terminals of the secondary winding $54_2$ and a negative voltage $-V_3$ appears at the terminals of the secondary winding $54'_2$. Since the absolute value of this voltage $V_3$ is greater than the absolute values of the voltages $V_1$ and $V_2$, the capacitors $C_{15}$ and $C_{14}$ are respectively charged at the voltages:

$$VS_1 = +V_3 - V_1 \text{ (FIG. 5-c)}$$

$$VS_2 = -V_3 + V_2 \text{ (FIG. 5-d)}$$

Indeed, a current for the charging of the capacitor $C_{15}$ flows from the output terminal 56 to the terminal 58, and then to the terminal 29, in the capacitor $C_1$ towards the terminal 38 and returns to the other output terminal of the secondary winding $54_2$ by the diode $D_1$ which is conductive while the diode $D_2$ is off.

Besides, a current for the charging of the capacitor $C_{14}$ flows from the output terminal 57 to the terminal 58, and then to the terminal 49, in the capacitor $C_3$ towards the terminal 48 and returns to the other output terminal of the secondary winding $54'_2$ by the diode $D_3$ which is conductive while the diode $D_4$ is off. The voltage $VS_1$ remains at the value $(V_3-V_1)$ after the end of the pulse 70 owing to the presence of the voltage $+V_2$ which keeps the diode $D_2$ in an off state. In the same way, the voltage $VS_2$ remains at the value $(-V_3+V_2)$ after the end of the pulse 70 owing to the presence of the voltage $+V_1$ which keeps the diode $D_4$ off.

The pulse 71 saturates the transistor $T_2$ in such a way that a negative voltage $-V_3$ appears at the terminals of the secondary winding $54_2$ and a positive voltage $+V_3$ appears at the terminals of the secondary winding $54'_2$, namely biases opposite to those resulting from the pulse 70, these biases being indicated by the corresponding arrows. The capacitors $C_{15}$ and $C_{14}$ are respectively charged at the voltages:

$$VS'_1 = -V_3 + V_1 \text{ (FIG. 5-c)}$$

$$VS'_2 = +V_3 - V_1 \text{ (FIG. 5-d)}$$

Indeed, a current flows in the capacitor $C_{15}$ from the terminal 58 to the terminal 56, in the winding $54_2$, in the conductive diode $D_2$ (the diode $D_1$ is off) towards the terminal 47, in the capacitor $C_4$ towards the terminal 49 which is connected to the terminal 58.

Besides, a current flows in the capacitor $C_{14}$ from the terminal 58 to the terminal 57, in the winding $54'_2$, in the conductive diode $D_4$ (the diode $D_3$ is off) towards the terminal 37, in the capacitor $C_2$ towards the terminal 39 which is connected to the terminal 58.

The voltage $VS'_1$ remains at the value $(-V_3+V_2)$ after the end of the pulse 71 owing to the presence of the voltage $-V_1$ which keeps the diode $D_1$ in an off state. In the same way, the voltage $VS'_2$ remains at the value $(V_3-V_1)$ after the end of the pulse 71 owing to the presence of the voltage $-V_2$ which keeps the diode $D_3$ in its off state.

Should the time interval between the switch-over pulses 70 and 71 be great, and should this lead to a slight discharge of the capacitors $C_{15}$ and $C_{14}$, they can be kept at the charging voltage through the renewed application of one or more pulses 70 for the time interval between a pulse 70 and a pulse 71 or one or more pulses 71 for the time interval between a pulse 71 and a pulse 70. Thus, the voltages $VS_1$, $VS_2$ and $VS'_1$, $VS'_2$ may be kept at these values for as long as is desirable, and even continuously.

To modify the voltages $VS_1$, $VS_2$ and $VS'_1$, $VS'_2$, it is sufficient to modify $\pm V_1$ and $\pm V_2$ in changing the corresponding frequencies $F_1$ and $F_2$ by means of the microprocessors 31 and 41 respectively.

Since all the voltages $\pm V_1$, $\pm V_2$ and $\pm V_3$ are obtained at the transformer secondary winding terminals 35, 45 and 54, the output terminals 56, 57 and 58 may be carried to any potential, for example that of the cathode, namely $-75$ kilovolts, without using any special protection circuit.

What is claimed is:

1. A device used for providing switched X-ray tube electrode biasing voltages $VS_1$, $VS_2$ or $VS'_1$, $VS'_2$, comprising:

first means for generating a first pair of adjustable DC voltages $+V_1$, $-V_1$ with equal and opposite amplitudes, second means for generating a second pair of adjustable DC voltages $+V_2$, $-V_2$ with equal and opposite amplitudes, third means for generating a pair of pulse voltages $+V_3$, $-V_3$ with equal and opposite amplitudes, and fourth means connected to said first, second and third means, for combining the pair of pulse voltages $+V_3$, $-V_3$, at determined instants, with one of the voltages of the first and second pairs of DC voltages so as to charge capacitors and obtain DC voltages $$VS_1 = V_3 - V_1 \text{ and } VS_2 = -V_3 + V_2$$

during a certain period of time, and to provide DC voltages during another period of time.

$$VS'_1 = -V_3 + V_2 \text{ and } VS'_2 = +V_3 - V_1$$

during another period of time.

2. A device according to claim 1, wherein said third means comprise a pulse type transformer comprising two primary windings and two secondary windings in opposite directions, which are powered by a DC voltage E that is constant and regulated by means of two switches, each switch being normally open and being closed by a pulse.

3. A device according to claim 2, wherein said fourth means comprise:

a first pair of diodes in series, the common point of which is connected to an output terminal of one of said two secondary windings, the anode of one of the diodes being connected to the terminal of said first means generating the voltage $-V_1$ and the cathode of the other diode being connected to the terminal of said second means generating the voltage $+V_2$, and a second pair of diodes in series, the common point of which is connected to an output terminal of said other secondary winding, the anode of one of the diodes being connected to the terminal of said second means generating, the voltage $-V_2$ and the cathode of the other diode being connected to the terminal of said means generating the voltage $+V_1$.

4. A device according to any of claims 1, 2 or 3, wherein said first means or second means each comprise:

supply means for supplying a constant DC voltage E, means for converting said DC voltage E so as to obtain AC pulses with a frequency F, each corresponding to a quantity of electricity that is constant from one pulse to the next one;

means for rectifying and filtering said AC pulses so as to obtain said DC voltage $V_p$, means for modifying the frequency F of said AC pulses as a function of the DC voltage $V_p$ that is to be obtained.

5. A device according to claim 4, wherein said means for converting said constant DC voltage E comprise a resonant circuit, the resonance frequency of which is greater than the frequency F.

6. A device according to claim 4, wherein said means for modifying the frequency F of said AC pulses comprise:

means for determining, by calibration, the frequency F of said pulses as a function of the voltage $V_p$ to be obtained, means for generating control pulses at the frequency F from the information on the value of said frequency F, said pulses being applied to said means for converting said DC voltage E.

7. A device according to claim 6, wherein said means for generating control pulses at the frequency F comprise:

a counter circuit that provides the F frequency pulses, and a logic circuit that provides signals for controlling said converter means for converting the voltage E, the duration of said signals being greater than one half-period but smaller than said resonance period, the repetition period of said signals being at most equal to said resonance period.

8. A device according to claim 7, wherein said logic circuit comprises:

a first AND circuit, one of the two input terminals of which is connected to the output terminal, of said counter circuit, a bistable circuit, the control input terminal of which is connected to the output terminal of said first AND circuit so as to change state at each signal produced by the first AND circuit;

a second AND circuit, one of the two input terminals of which is connected to the output terminal of said bistable circuit corresponding to the state 1;

a third AND circuit, one of the two input terminals of which is connected to the output terminal of said bistable circuit corresponding to the state 0;

a first delay circuit, the input terminal of which is connected to the output terminal of said first AND circuit and the output terminal of which is connected to the second input terminal of said first AND circuit, and a second delay circuit, the input terminal of which is connected to the output terminal of said first AND circuit and the output terminal of which is connected to the other input terminal of said second and third AND circuits.

* * * * *

UNITED STATES PATENT AND TRADEMARK OFFICE

CERTIFICATE OF CORRECTION

PATENT NO. : 5,200,645

DATED : April 6, 1993

INVENTOR(S) : Jacques Laeuffer

It is certified that error appears in the above-identified patent and that said Letters Patent is hereby corrected as shown below:

Title page, item [57]
In the Abstract, last line, change "$-VS_3$" to -- $-V_3$ --.

Column 1, line 14, change "baked" to --backed--.

Column 2, line 30, change "$+V_1$" to -- $\pm V_1$ --;

line 31, delete "(1";

line 33, change "$+V_2$" to -- $\pm V_2$ --.

Column 3, line 61, change "a" to --an--.

Column 4, line 29, change "$+V_2$)" to -- $\pm V_2$) --;

line 52, change "circuit" to --device-- and change "device" to --circuit--;

line 56, change "$+V_1$, $+V_2$" to -- $\pm V_1$, $\pm V_2$ --.

Column 5, line 10, change "$+V_1$(or $+V_2$)" to -- $\pm V_1$ (or $\pm V_2$) --;

line 21, change "circuit" to --counter--;

line 22, delete "C".

UNITED STATES PATENT AND TRADEMARK OFFICE

CERTIFICATE OF CORRECTION

PATENT NO. : 5,200,645

DATED : April 6, 1993

INVENTOR(S) : Jacques Laeuffer

It is certified that error appears in the above-identified patent and that said Letters Patent is hereby corrected as shown below:

Column 6, line 12, delete ",";

line 24, change "gives" to --provides--.

Column 8, line 9, change "$I_4$" to -- $I_r$ --;

line 34, after "$L_3$" insert --is--.

Column 9, line 25, change " $+V_1$, $+V_2$" to -- $\pm V_1$, $\pm V_2$ --.

Column 10, line 18, change "29" to --39--;

line 45, change to read -- $VS'_2 = + V_3 - V_2$ (FIG. 5-d) --.

Column 11, line 40, delete "during another period of time."

Column 12, line 2, after "said" insert --first--.

Signed and Sealed this

Twenty-second Day of February, 1994

*Attest:*

Bruce Lehman

BRUCE LEHMAN

*Attesting Officer*

*Commissioner of Patents and Trademarks*